US010837464B2

(12) United States Patent
Harris

(10) Patent No.: US 10,837,464 B2
(45) Date of Patent: Nov. 17, 2020

(54) JET PUMP

(71) Applicant: George E. Harris, Marshfield, MO (US)

(72) Inventor: George E. Harris, Marshfield, MO (US)

(73) Assignee: George E. Harris, Marshfield, MO (US)

( * ) Notice: Subject to any disclaimer, the term of this patent is extended or adjusted under 35 U.S.C. 154(b) by 0 days.

(21) Appl. No.: 16/644,402

(22) PCT Filed: Oct. 1, 2019

(86) PCT No.: PCT/US2019/053923

§ 371 (c)(1),
(2) Date: Mar. 4, 2020

(87) PCT Pub. No.: WO2020/072393

PCT Pub. Date: Apr. 9, 2020

(65) Prior Publication Data

US 2020/0232481 A1 Jul. 23, 2020

Related U.S. Application Data

(60) Provisional application No. 62/741,398, filed on Oct. 4, 2018.

(51) Int. Cl.
*F04F 5/46* (2006.01)
*E21B 43/12* (2006.01)
(Continued)

(52) U.S. Cl.
CPC ..... *F04F 5/46* (2013.01); *E21B 43/124* (2013.01); *F04F 5/00* (2013.01); *F04F 5/10* (2013.01); *F04F 5/467* (2013.01)

(58) Field of Classification Search
CPC ... E21B 43/124; F04F 5/10; F04F 5/46; F04F 5/00; F04F 5/48; F04F 5/54
See application file for complete search history.

(56) References Cited

U.S. PATENT DOCUMENTS 2,812,723 A * 11/1957 Coberly ..... F04F 5/467 417/189
3,143,293 A 8/1964 Purse
(Continued)

FOREIGN PATENT DOCUMENTS

| | | | |
|---|---|---|---|
| CN | 105387006 | A | 3/2016 |
| DE | 102008007298 | B4 | 8/2009 |
| WO | 03036011 | A2 | 5/2003 |

OTHER PUBLICATIONS

International Search Report dated Dec. 4, 2019 in PCT Application No. US2019/053923.

(Continued)

*Primary Examiner* — Dominick L Plakkoottam
(74) *Attorney, Agent, or Firm* — John M. Hammond; Patent Innovations LLC

(57) ABSTRACT

A jet pump comprising a pump housing containing a jet nozzle and a throat diffuser nozzle. The jet nozzle is comprised of a jet nozzle insert disposed in an axial inner bore of a precision jet cylindrical body and formed of an ultra-hard material. The throat diffuser nozzle is comprised of a throat diffuser nozzle insert disposed in an axial inner bore of a precision throat diffuser cylindrical body and also formed of an ultra-hard material. The jet nozzle and throat diffuser nozzle are disposed in an elongated cylindrical central bore portion of a tubular side wall of the pump housing. In order to achieve highest concentricity of the axial inner bores, the axial inner bore of the jet nozzle insert (Continued)

and the axial inner bore of the throat diffuser nozzle insert are formed after placement in the precision cylindrical bodies.

19 Claims, 11 Drawing Sheets

(51) Int. Cl.
*F04F 5/10* (2006.01)
*F04F 5/00* (2006.01)

(56) References Cited

U.S. PATENT DOCUMENTS 5,372,190 A 12/1994 Coleman
6,354,371 B1 3/2002 OBlanc
7,347,259 B2 3/2008 Ravensbergen
7,909,089 B2 * 3/2011 Jackson ..... E21B 43/124 166/68
9,382,922 B2 7/2016 Dunning
2005/0077042 A1 * 4/2005 Ravensbergen ..... F04F 5/46 166/242.4
2005/0121191 A1 * 6/2005 Lambert ..... E21B 37/00 166/265
2010/0101798 A1 4/2010 Simpson
2011/0136068 A1 * 6/2011 Lenk ..... F23D 14/64 431/215
2014/0003965 A1 * 1/2014 James ..... F04F 5/48 417/53
2015/0233221 A1 * 8/2015 Stokley ..... F04F 5/46 417/195
2016/0138616 A1 * 5/2016 Pugh ..... E21B 43/124 417/53
2017/0247962 A1 * 8/2017 Jackson ..... F04F 5/48
2018/0202270 A1 * 7/2018 Falk ..... B23P 15/00

OTHER PUBLICATIONS

Written Opinion of the International Search Authority dated Dec. 4, 2019 in PCT Application No. US2019/053923.

* cited by examiner

JET PUMP

CROSS-REFERENCE TO RELATED PATENT APPLICATIONS

This application claims the benefit of U.S. Provisional Patent Application No. 62/741,398 filed Oct. 4, 2018, the disclosure of which is incorporated herein by reference.

TECHNICAL FIELD

Pumps for moving fluids using the venturi principle. More particularly, jet pumps used in chemical processing, producing water and oil and gas production.

BACKGROUND ART

A jet pump functions by using a high energy flow of a first fluid or gas (referred to herein as a power fluid) to cause a flow of a second fluid or gas (referred to herein as a fluid). The physical principle of operation of a jet pump is similar to that of a jet engine. A jet pump includes a jet nozzle and venturi, through which the high energy fluid passes. In the venturi, in accordance with the Bernoulli principle, the fluid velocity increases, and the fluid pressure decreases. This low pressure region presents an opportunity to introduce a second fluid (referred to herein as a production fluid) into the flowing stream. One or more ports may be provided at the venturi, through which the production fluid may be introduced. The local low pressure causes the production fluid to flow through the port(s), and the production fluid is entrained and mixed into the power fluid. The combined power and production fluid mixture may pass through an expanding passageway (commonly referred to as a diffuser), whereby the flow regime reverts to a low velocity high pressure flow, again in accordance with the Bernoulli principle.

Jet pumps are utilized in a broad range of applications in fluid and gas transport, and chemical processing. In particular, jet pumps are used in the oil and gas industry, in both surface transport, refining processing and extraction from wells. When placed deep into the bore of a well, a jet pump can be a highly effective device for oil and gas production, lifting the oil and gas from the well to ground level. Jet pumps have been used in such applications since the late 1960s.

Although substantial performance improvements have been made, certain problems remain to be solved. Conventional jet pumps typically require significant production fluid inlet pressure relative to power fluid pressure to minimize or eliminate cavitation in the pump. Cavitation is avoided for a number of reasons; it is known to cause erosion and destruction of pump components, nucleation and effervescence of solubilized gas from the production fluid, and loss of pump efficiency. These are known facts acknowledged by many jet pump manufacturers. In one phenomenon, cavitation occurs at or immediately downstream from the pump venturi when the local fluid pressure decreases to a level at or below the vapor pressure of the flowing liquid (including the production fluid) or a constituent of the fluid. Vapor bubbles are formed in the flowing liquid. When oil or an oil/water mixture is the production liquid, the vapor bubbles may include low molecular weight volatile organic compounds (VOCSs), and in some instances, natural gas. Further downstream, as the flowing liquid passes through a diffuser, thus reducing the flow velocity and increasing the pressure, the formed bubbles will collapse instantaneously, resulting in microscopic regions of high pressure. When this occurs at a solid surface of the pump, such as the wall of the throat or the diffuser, the solid material at the wall may be eroded. Over time, the solid surface may become eroded substantially, having a pitted appearance. The particular part that is being eroded may become structurally weak, and/or worn to the point of having the wall breached and/or otherwise unsuitable for use in the pumping application. The phenomenon of cavitation in a jet pump, and the resulting damage caused by cavitation, is described in detail in *Gas Well Deliquification*, (*Second Edition*), James Lea et al., Gulf Professional Publishing, 2008.

In order to avoid cavitation, in conventional practice, jet pumps require that the production fluid be supplied to the pump under substantial positive pressure, or net positive suction head (NPSH). In many oil wells, a high NPSH of production fluid, i.e. one such fluid being oil available at the location in the well bore where the pump is placed, is not available. In other wells, sufficient NPSH may be available in the early stages of production from the well, but then NPSH decreases over time to a level insufficient for the pump to operate efficiently without cavitating. In general, a highly significant problem with existing jet pumps is the inability to operate efficiently or at all at reduced NPSH over long pumping intervals.

At a given pump efficiency, a set amount of power fluid at a given pressure is required to lift a fixed volume/weight of production fluid, such as oil from a well. This quantity of fluid at the given pressure can be converted to a horsepower requirement. As the formation fluid level and head pressure is drawn down in a well, the production fluid pressure at the pump inlet declines. Accordingly, in order to maintain the same flowrate of production fluid to the surface, the horsepower applied via the power fluid must be increased; effectively, as the level of production fluid in the well decreases, the pump must lift the production fluid a greater distance relative to ground level.

To gain this added power fluid horsepower, one can increase production fluid pressure and/or inlet flow rate. However, such increases in pressure and/or flow may result in cavitation within the pump as described above. In conventional jet pumps, if cavitation is occurring, the inlet power fluid pressure must be reduced in order to eliminate the cavitation and resultant pump damage, thereby reducing power fluid horsepower. In order to maintain the desired production rate, this must be offset by an increase in the flow rate of the power fluid. But as the inlet pressure is reduced to a level to avoid cavitation, the volume of power fluid required to maintain or increase delivered pumping horsepower at lower pressure causes greater friction losses due to limited space available in the tubing/casing in the well. The result is substantially increased capital and operating costs due to larger pumps, tubing and horsepower (fuel costs) being required to maintain oil production goals.

What is needed is a jet pump, which is capable of pumping oil at a minimal (or even zero) NPSH, and/or which is capable of effective operation with cavitation, and which is not rendered inoperable during prolonged use under cavitation.

DISCLOSURE OF THE INVENTION

In accordance with the present disclosure, a jet pump is provided that meets these needs.

One aspect of jet pumps of the present disclosure is based on the use of certain ultra-hard materials for key components of the pump, and the discovery of techniques for assembling and fabricating the components in a manner that places them in a highly precise coaxial alignment when assembled in the pump. The Applicant has discovered that the use of these materials, and/or these assembly and fabrication techniques result in a pump that is capable of pumping oil under a zero NPSH, and which is capable of effective operation with cavitation.

Another aspect of the jet pumps of the present disclosure is the development of a submodule of the pump comprised of a removable cartridge, within which the positions of the jet nozzle and the throat diffuser nozzle are adjustable relative to each other, while also maintaining precise coaxial alignment. This enables adjustability of the gap between them, within which the production fluid is introduced. Such an adjustable gap provision, while also maintaining precise coaxial alignment of the jet nozzle and throat diffuser nozzle, enables tuning of the pump to optimize its performance for the particular oil or other gas/fluid being pumped (e.g., its rheology and chemical composition), and the particular production fluid pressure that is present in the well bore at the pump.

Yet another aspect of the present disclosure is a jet pump comprised of removable nozzles placed in a fixed bore, instead of a removable cartridge. The nozzles may be offset from the central axis of the pump body. Advantageously, this configuration provides a much larger annular space within the pump for the flow of production fluid.

More specifically, in accordance with the present disclosure, a jet pump is provided, which is comprised of a pump housing containing a jet nozzle and a throat diffuser nozzle. The pump housing is comprised of a tubular side wall including an outer central side wall region, and an inner side wall defining a central passageway including a first fluid inlet portion, an elongated cylindrical central bore portion in fluid communication with the first fluid inlet portion and having at least one through port extending through the outer central side wall region, and at least one combined fluid outlet portion in fluid communication with the elongated cylindrical central bore portion.

The jet nozzle is disposed in a jet nozzle region of the elongated cylindrical central bore portion of the tubular side wall of the pump housing. The jet nozzle may be comprised of a jet cylindrical body and a jet nozzle insert. The jet cylindrical body may be formed of a jet nozzle outer material such as stainless steel. Other materials, including but not limited to plastics, carbides and other metals may be used for fabricating the jet cylindrical body, depending upon the particular jet pump application. The jet cylindrical body is disposed in the jet nozzle region of the elongated central bore of the pump housing, and includes an axial inner bore therethrough.

The jet nozzle insert is formed of a jet nozzle inner material, which is preferably an extremely hard material that is resistant to erosion by cavitation, corrosion, and to wear by abrasive solid particles, such as sand entrained in a fluid flowing therethrough. The jet nozzle insert is disposed in an axial inner bore of the jet cylindrical body. The jet nozzle insert includes an axial inner bore therethrough, which is coaxial with the axial inner bore of the jet cylindrical body. The axial inner bore of the jet nozzle insert is comprised of a frustoconical region contiguous with a frustoconical region of the axial inner bore of the jet cylindrical body. The axial inner bore of the jet nozzle insert may further include a region of constant diameter in fluid communication with the frustoconical region of the axial inner bore of the jet nozzle insert. In alternative embodiments, the jet nozzle may be fabricated entirely from a single hard material. In certain embodiments, the jet nozzle may be fabricated entirely from a single piece of the extremely hard material. In other embodiments, the jet nozzle may be fabricated from at least two pieces of the extremely hard material, with at least two pieces joined together by a suitable process such as brazing. In view of the presence of some minimal joining interfacial material (such as brazing compound), these alternative jet nozzles consist essentially of the extremely hard material. These alternative embodiments eliminate the need for the jet cylindrical body.

The throat diffuser nozzle is disposed in a throat diffuser nozzle region of the elongated cylindrical central bore portion of the tubular side wall of the pump housing. The throat diffuser nozzle may be comprised of a throat diffuser cylindrical body and a throat diffuser nozzle insert. The throat diffuser cylindrical body may be formed of a throat diffuser nozzle outer material such as stainless steel, and is disposed in the throat diffuser nozzle region of the elongated central bore of the pump housing, and includes an axial inner bore therethrough. In alternative embodiments, the entire throat diffuser nozzle may be fabricated entirely from a single hard material. In certain embodiments, the throat diffuser nozzle may be fabricated entirely from a single piece of the extremely hard material. In other embodiments, the throat diffuser nozzle may be fabricated from at least two pieces of the extremely hard material, with at least two pieces joined together by a suitable process such as brazing. In view of the presence of some minimal joining interfacial material (such as brazing compound), these alternative throat diffuser nozzles consist essentially of the extremely hard material. These alternative embodiments eliminate the need for the throat diffuser cylindrical body.

The throat diffuser nozzle insert is formed of a throat diffuser nozzle inner material, which preferably is also an ultra-hard material. The throat diffuser nozzle insert is disposed in an axial inner bore of the throat diffuser cylindrical body, and is separated from the jet nozzle insert by a gap located at the through port of the elongated cylindrical central bore portion of the tubular side wall. The throat diffuser nozzle insert includes an axial inner bore therethrough coaxial with the axial inner bore of the throat diffuser cylindrical body. The axial inner bore of the throat diffuser nozzle insert is comprised of a frustoconical region contiguous with a frustoconical region of the axial inner bore of the throat diffuser cylindrical body.

The jet pump may be further comprised of a pump body surrounding the pump housing, and including fluid passageways and inlet ports, and an outlet port, for supplying fluids to the pump and expelling fluid from the pump. A first fluid inlet port is in communication with an upper central passageway in the pump body and includes an inner side wall contiguous with an outer upper side portion of the tubular side wall of the pump housing. A middle central passageway in the pump body is in communication with the upper central passageway and includes an inner side wall surrounding the outer central side wall region of the tubular side wall of the pump housing, which defines an annular cavity therebetween in fluid communication with the at least one through port extending through the outer central side wall region. A lower central passageway in the pump body is in communication with the middle central passageway, and is in communication with an outlet port in the pump body, and includes an inner side wall contiguous with an outer lower side portion of the tubular side wall of the pump housing. A second fluid inlet port at a distal end of the pump body is in fluid communication with the annular cavity. In certain embodiments, the pump body may be comprised of an upper body member including the first fluid inlet port and the middle central passageway joined to a lower body member including the lower central passageway and the second fluid inlet port.

In certain embodiments of the pump and fabrication methods thereof, a jet nozzle insert piece may be fitted into the jet cylindrical body, and the frustoconical region of the jet nozzle insert contiguous with the frustoconical region of the axial inner bore of the jet cylindrical body may then be formed by a machining tool, and a throat diffuser nozzle insert piece may be fitted into the throat diffuser cylindrical body, and the frustoconical region of the throat diffuser nozzle insert contiguous with the frustoconical region of the axial inner bore of the throat diffuser cylindrical body may then be formed by the machining tool. The machining tool may include an electro discharge machining (EDM) tool, a laser, or other suitable subtractive material process tool.

BRIEF DESCRIPTION OF THE DRAWINGS

The present disclosure will be provided with reference to the following drawings, in which like numerals refer to like elements, and in which.

Figure 1A:
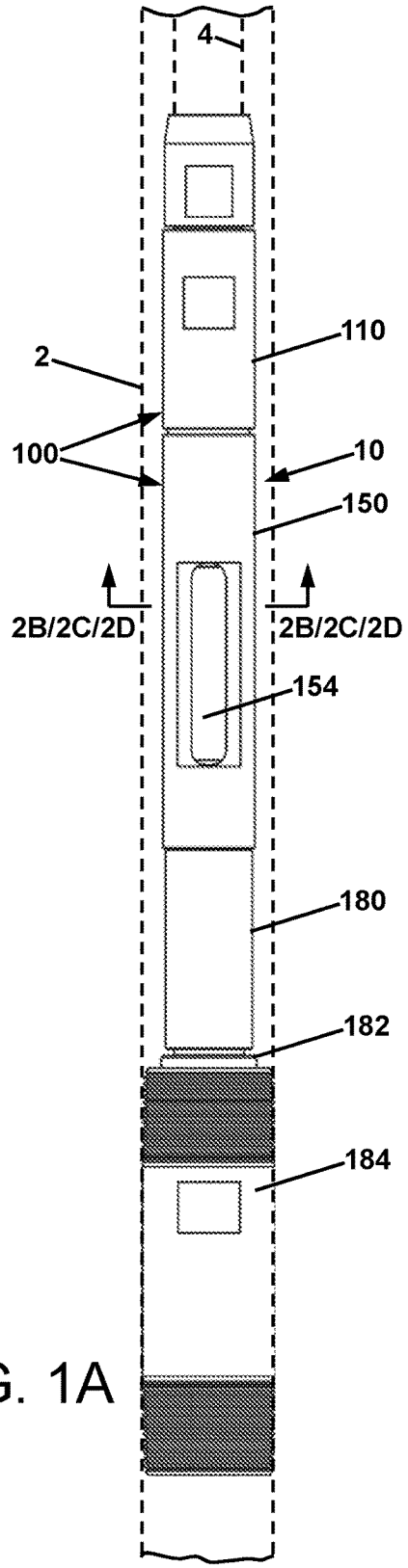
FIG. 1A is a side elevation view of a jet pump of the present disclosure.

The present invention will be described in connection with certain preferred embodiments. However, it is to be understood that there is no intent to limit the invention to the embodiments described. On the contrary, the intent is to cover all alternatives, modifications, and equivalents as may be included within the spirit and scope of the invention as defined by the appended claims.

BEST MODE FOR CARRYING OUT THE INVENTION

For a general understanding of the present invention, reference is made to the drawings. In the drawings, like reference numerals have been used throughout to designate identical elements. The drawings are to be considered exemplary, and are for purposes of illustration only. The dimensions, positions, order and relative sizes reflected in the drawings attached hereto may vary.

In the following disclosure, certain components may be described with adjectives such as "top," "upper," "bottom," "lower," "left," "right," "inner," "outer," etc. These adjectives are provided in the context of use of the orientation of the drawings, which is arbitrary. The description is not to be construed as limiting the jet pump to use in a particular spatial orientation. The instant jet pump may be used in orientations other than those shown and described herein. Additionally, the use of the jet pump in the extraction of oil and gas described herein is to be considered as an exemplary use. The jet pump may be used in many other fluid pumping applications.

It is also to be understood that any connection references used herein (e.g., attached, coupled, connected, and joined) are to be construed broadly and may include intermediate members between a collection of elements and relative movement between elements unless otherwise indicated. As such, connection references do not necessarily imply that two elements are directly connected and in fixed relation to each other.

Turning first to FIGS. 1A-1C and FIG. 2, a jet pump 10 of the present disclosure is depicted within a well casing 2 and connected to well tubing 4. It is to be understood that for the sake of simplicity of illustration, the well casing 2 and well tubing 4 are illustrated schematically. The particular connection and sealing of the jet pump 10 to the well casing 2 and well tubing 4 via threaded connections, gaskets, O-rings, etc. will be apparent to those skilled in the art, and thus are not presented in the drawings.

The jet pump 10 is comprised of a pump housing 20 containing a jet nozzle 40 and a throat diffuser nozzle 60. The pump housing 20 holds the jet nozzle 40 and throat diffuser nozzle 60 in precise coaxial alignment. In operation of the jet pump 10 in an oil well casing 2, the assembly including the housing 20, jet nozzle 40, and throat diffuser nozzle 60 may function as a removable cartridge 11 or 13 (FIG. 3A and FIG. 4A) that is contained in a pump body 100 to be described subsequently. The cartridge 11/13 may be delivered and installed in the pump body 100 hydraulically by fluid flow down the well tubing 4, and the cartridge 11/13 may be removed from the pump body 100 hydraulically by reverse fluid flow or wireline up the well tubing 4.

Figure 3A:
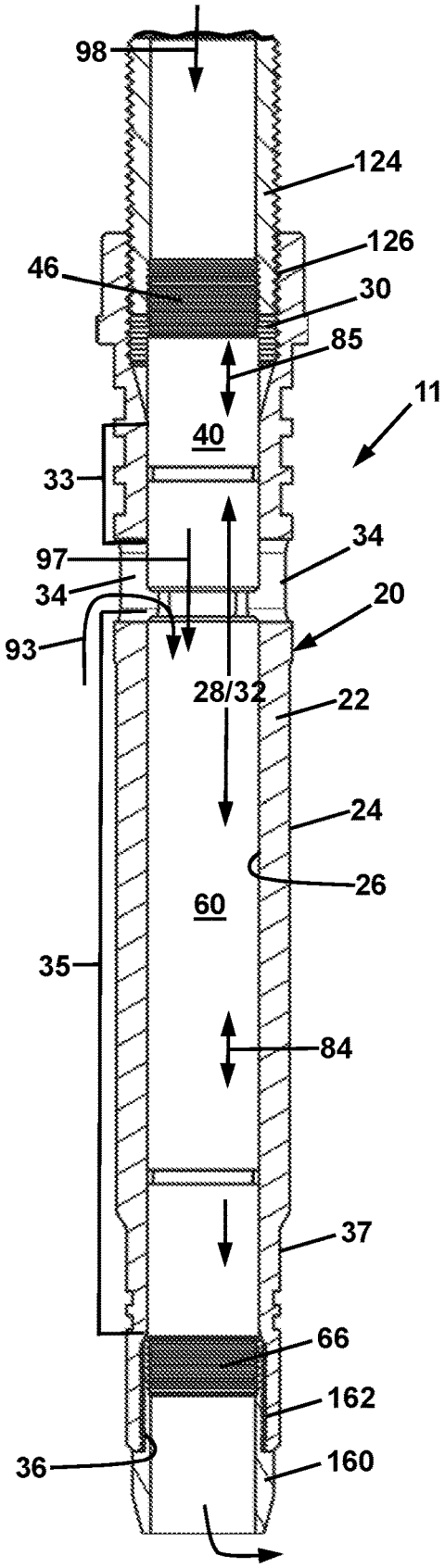
FIG. 3A is a detailed cross-sectional view of a pump cartridge for standard flow mode.
Figure 4A:
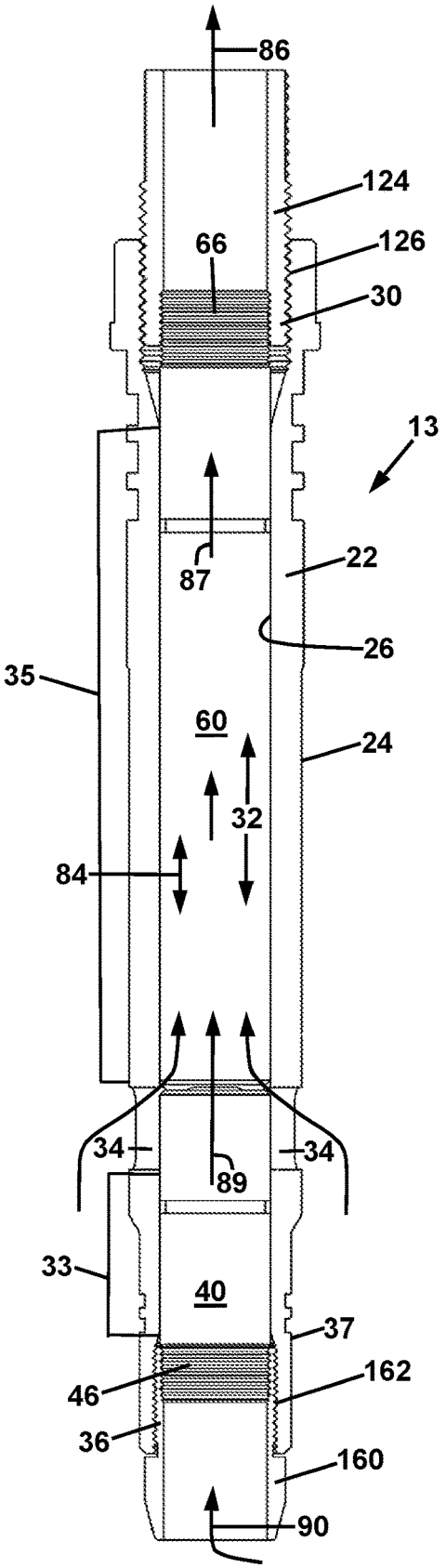
FIG. 4A is a detailed cross-sectional view of a pump cartridge configured for reverse flow mode.

Referring also to FIGS. 3A and 4A, the pump housing 20 is comprised of a tubular side wall 22, which includes an outer central side wall region 24, and an inner side wall 26 defining a central passageway 28. The central passageway 28 is preferably machined precisely so as to have a continuous constant inside diameter. The central passageway 28 includes a first fluid inlet portion 30, an elongated cylindrical central bore portion 32 in fluid communication with the first fluid inlet portion 30 and having at least one through port 34 extending through the outer central side wall region 24, and a combined fluid outlet portion 36 in fluid communication with the elongated cylindrical central bore portion 32.

Figure 5A:
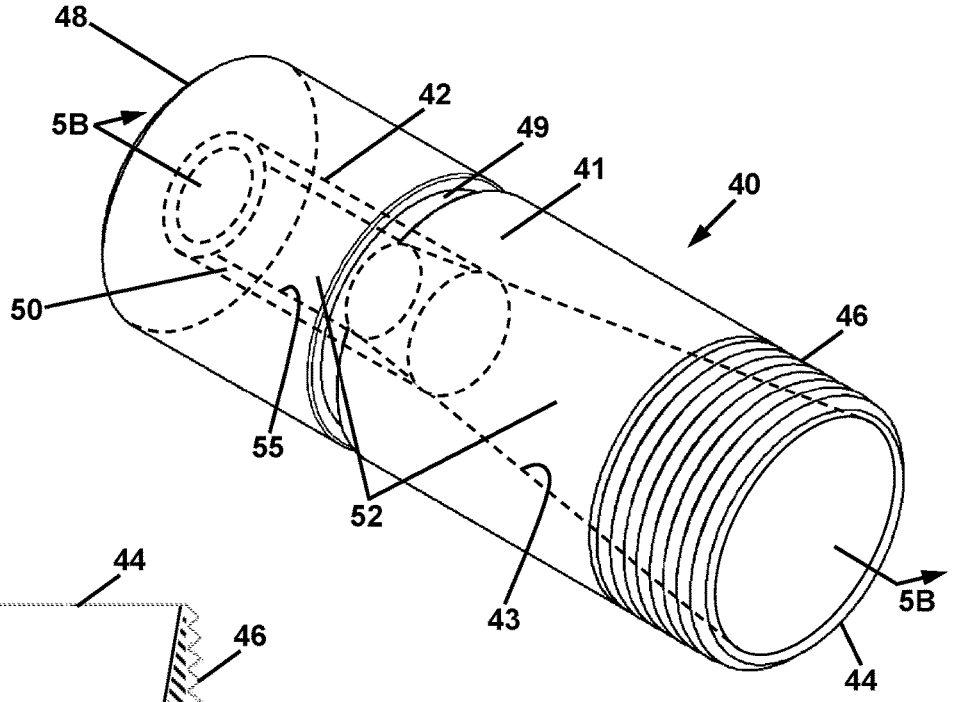
FIG. 5A is a perspective view of a jet nozzle of the jet pump.
Figure 5B:
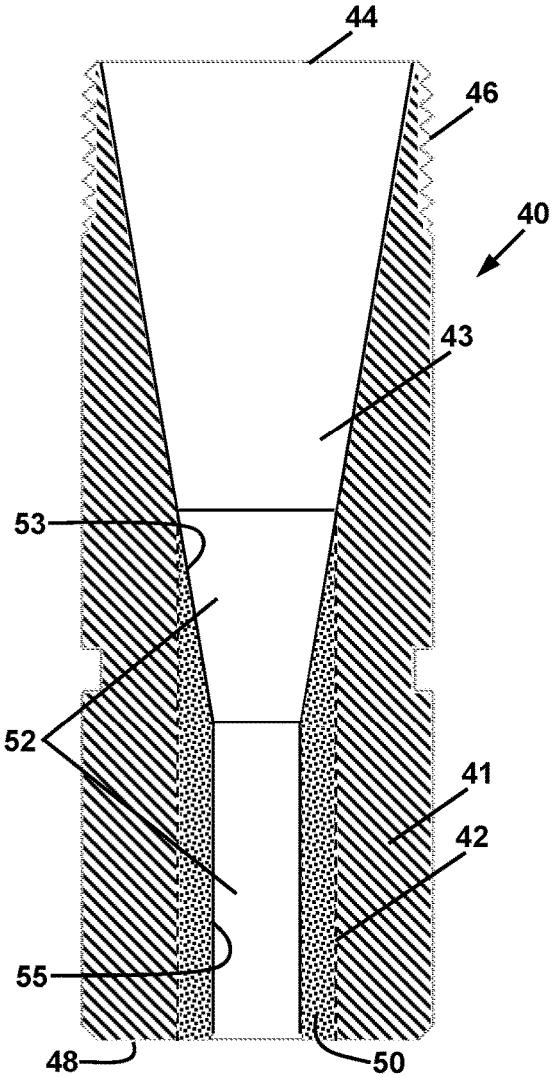
FIG. 5B is a detailed cross-sectional view of the jet nozzle, taken along line 5B-5B of FIG. 5A.

The jet nozzle 40 is disposed in a jet nozzle region 33 of the elongated cylindrical central bore portion 32 of the tubular side wall 22 of the pump housing 20. Referring also to FIGS. 5A and 5B, the jet nozzle 40 is comprised of a jet cylindrical body 41 and a jet nozzle insert 50. The jet cylindrical body 41 is preferably formed of a corrosion resistant material such as stainless steel and is disposed in the jet nozzle region 33 of the elongated central bore 32 of the pump housing 20, and includes an axial inner bore 42 therethrough.

The jet nozzle insert 50 is formed of a suitable structural material, which is preferably an extremely hard material that is resistant to erosion by cavitation, corrosion and to wear by abrasive solid particles, such as sand entrained in a fluid flowing therethrough. In certain embodiments, the jet nozzle insert 50 may be made of polycrystalline diamond. Other hard materials, including but not limited to titanium carbide, silicon carbide, boron carbide, polycrystalline cubic boron nitride, hardened steel, monocrystalline diamond, and the like may be used as suitable alternatives, depending on the particular circumstances. In general, the material preferable has at least a hardness value of 8 on the Mohs scale of hardness, and more preferably, at least a hardness value of 9 on the Mohs scale of hardness.

The jet nozzle insert 50 is disposed in the axial inner bore 42 of the jet cylindrical body 41. The jet nozzle insert 50 includes an axial inner bore 52 therethrough, which is coaxial with the axial inner bore 42 of the jet cylindrical body 41. The axial inner bore 52 of the jet nozzle insert 50 is comprised of a frustoconical region 53 contiguous with a frustoconical region 43 of the axial inner bore 52 of the jet cylindrical body 41 extending to the proximal end 44 thereof. The axial inner bore 52 of the jet nozzle insert 50 may further include a region 55 of constant diameter in fluid communication with the frustoconical region 53 of the axial inner bore 52 of the jet nozzle insert 50.

Figure 6B:
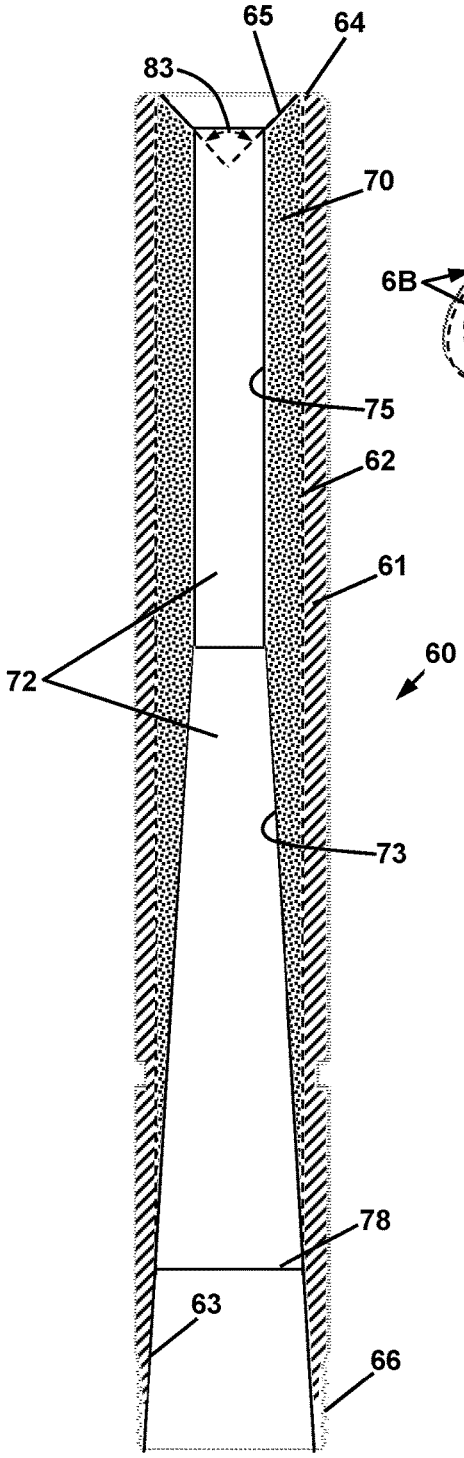
FIG. 6B is a detailed cross-sectional view of the throat diffuser nozzle, taken along line 6B-6B of FIG. 6A.
Figure 6A:
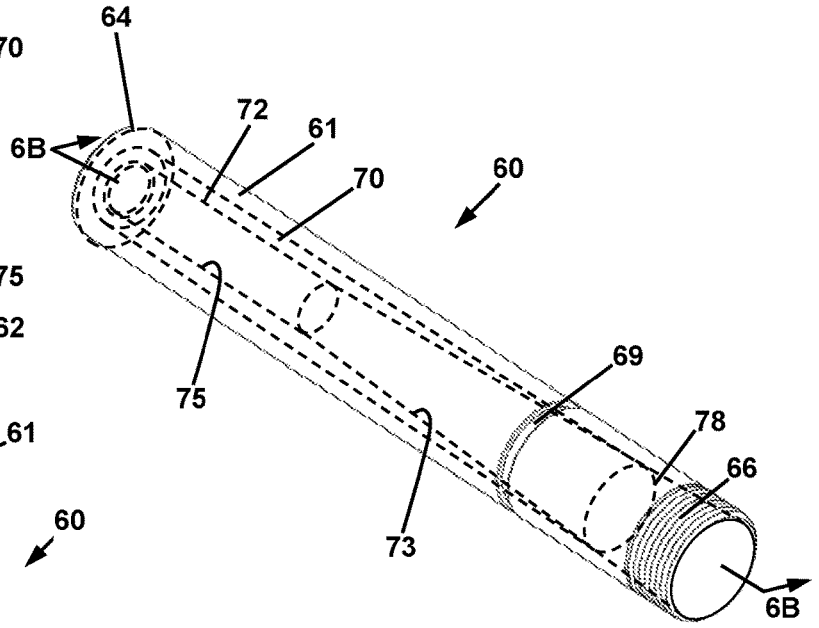
FIG. 6A is a perspective view of a throat diffuser nozzle of the jet pump.

Referring again to FIGS. 3A and 4A, the throat diffuser nozzle 60 is disposed in a throat diffuser region 35 of the elongated cylindrical central bore portion 32 of the tubular side wall 22 of the pump housing 20. Referring also to FIGS. 6A and 6B, the throat diffuser nozzle 60 is comprised of a throat diffuser cylindrical body 61 and a throat diffuser nozzle insert 70. The throat diffuser cylindrical body 61 is formed of a corrosion-resistant material such as stainless steel, and is disposed in the throat diffuser nozzle region 35 of the elongated central bore portion 32 of the pump housing 20, and includes an axial inner bore 62 therethrough.

Figure 3B:
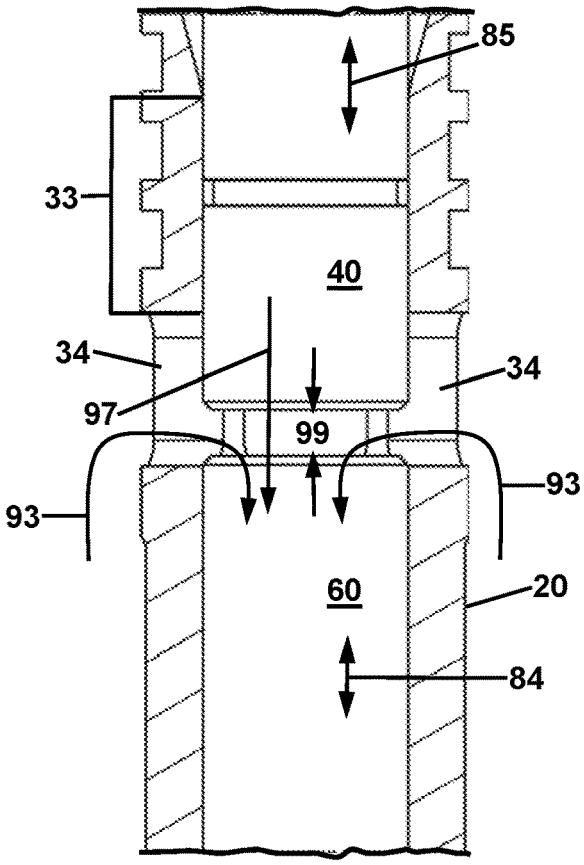
FIG. 3B is a detailed cross-sectional view of the gap region between a jet nozzle and a throat diffuser nozzle of the cartridge of FIG. 3A.

Like the jet nozzle insert 50, the throat diffuser nozzle insert 70 is preferably also formed of an extremely hard material that is wear resistant. In certain embodiments, the throat diffuser nozzle insert 70 may be made of polycrystalline diamond. The throat diffuser nozzle insert 70 is disposed in the axial inner bore 62 of the throat diffuser cylindrical body 61. Additionally, referring also to FIG. 3B, the throat diffuser nozzle 60 with throat diffuser nozzle insert 70 is separated from the jet nozzle 40 with jet nozzle insert 50 by a gap 99 located at the through port 34 of the elongated cylindrical central bore portion 32 of the tubular side wall 22 of the housing 20. The throat diffuser nozzle insert 70 includes an axial inner bore 72 therethrough coaxial with the axial inner bore 62 of the throat diffuser cylindrical body 61. The axial inner bore 72 of the throat diffuser nozzle insert 70 is comprised of a frustoconical region 73 contiguous with a frustoconical region 63 of the axial inner bore of the throat diffuser cylindrical body 61. The axial inner bore 72 of the throat diffuser nozzle insert 70 may further include a region 75 of constant diameter in fluid communication with the frustoconical region 73 of the axial inner bore 72 of the throat diffuser nozzle insert 70.

At the proximal end 64 of the throat diffuser nozzle 60, an entrance profile 65 may be provided to facilitate the entry of production fluid into the throat diffuser nozzle through the ports 34 (FIG. 2). By providing an entrance profile 65 (rather than a simple perpendicular sharp edge at the entrance to the axial inner bore 72 of the throat diffuser nozzle insert 70), a higher flow coefficient for the production fluid flow into the throat diffuser nozzle 70 is attained. In the embodiment shown in FIG. 6B, the entrance profile 65 is an angled profile defined by an included angle 83. The included angle may be between about 0 degrees and about 150 degrees. In one prototype pump that was fabricated, an included angle 83 of 35 degrees was provided. In another prototype pump that was fabricated and tested, an included angle 83 of 0 degrees was provided. In an alternative embodiment (not shown), a radiused entrance profile 65 may be provided.

Certain preferred methods of fabricating the pump housing 20, the jet nozzle 40 and throat diffuser nozzle 60, and the advantages resulting from such fabrication methods will be described subsequently herein.

Referring again to FIGS. 1A-1C, FIG. 2, FIG. 3A, and FIG. 4A, the jet pump 10 may be further comprised of a pump body 100 surrounding the pump housing 20. The pump body 100 includes fluid passageways and inlet ports, and an outlet port for supplying fluids to the pump and expelling fluid from the pump 10. A first fluid inlet port 112 is in communication with an upper central passageway 114 in the pump body 10 and includes an inner side wall 116 contiguous with an outer upper side portion 31 of the tubular side wall 22 of the pump housing 20. A middle central passageway 118 in the pump body 10 is in communication with the upper central passageway 114 and includes an inner side wall 120 surrounding the outer central side wall region 24 of the tubular side wall 22 of the pump housing 20, which defines an annular cavity 122 therebetween in fluid communication with the at least one through port 34 extending through the outer central side wall region 24. A lower central passageway 152 in the pump body 100 is in communication with the middle central passageway 118, and is in communication with an outlet port 154 in the pump body 100. The lower central passageway 152 includes an inner side wall 153 contiguous with an outer lower side portion 37 of the tubular side wall 22 of the pump housing 20. In certain embodiments, the outlet port 154 may have an elongated oblong or slotted shape as shown in FIGS. 1A-1C and FIG. 2. In other embodiments (not shown), the outlet port may have one or several simple circular cross-sectional shapes or other curvilinear shapes.

A second fluid inlet port 156 at a distal end 157 of a lower body member 150 of the pump body 100 is in fluid communication with the annular cavity 122 through at least one longitudinal fluid port 158. In the embodiment shown in FIG. 1C, four longitudinal fluid ports 158A-158D are provided. In another embodiment, a single oblong elongated passageway may be provided, having a volume and cross-section extending from port 158A to 158D. Other porting arrangements are contemplated. FIGS. 2B-2D are cross-sectional views taken along line 2B/2C/2D-2B/2C/2D of FIG. 1A, showing exemplary alternative fluid port configurations within the jet pump. Referring to FIG. 2B, seven longitudinal fluid ports 158A-158G are provided in the lower body member 150. Referring to FIG. 2C, a single elongated oblong arcuate or partial annular passageway 158H are provided in the lower body member 150. The partial annular passageway 158H of FIG. 2C extends circumferentially through an angle of about 200 degrees. Preferably, the elongated partial annular passageway 158H extends around the pump body 100 perpendicular to a longitudinal axis of the elongated partial annular passageway 158H through an angle of at least 120 degrees. Referring to FIG. 2D, a maximally extended partial annular passageway 158J is provided in the lower body member 150. The partial annular passageway 158J extends circumferentially through an angle of about 270 degrees. Such partial annular passageways are advantageous because, according to fluid dynamics computations, they may increase the flow capacity of the jet pump by nearly 50 percent.

In the embodiment shown in FIGS. 1A-1C and FIG. 2, the pump body 100 is comprised of an upper body member 110 joined to a lower body member 150. The upper body member 110 includes the first fluid inlet port 112 and the middle central passageway 118. The lower body member 150 includes the lower central passageway 152 and the second fluid inlet port 156. In the embodiment shown in FIGS. 1A-1C and FIG. 2, the upper body member 110 is removably joined to the lower body member 150 by providing matching female and male threads on the threads on the upper body member 110 and lower body member 150, respectively.

In an alternative embodiment, as compared to the embodiments shown in FIGS. 1A-3B, the pump cartridge 11 or 13 or the pump housing 20 may be radially offset from the central axis of the pump body 100. Such a configuration enables the provision of a larger longitudinal fluid port within the pump, thereby increasing the capacity of the pump to transport production fluid.

Figure 7:
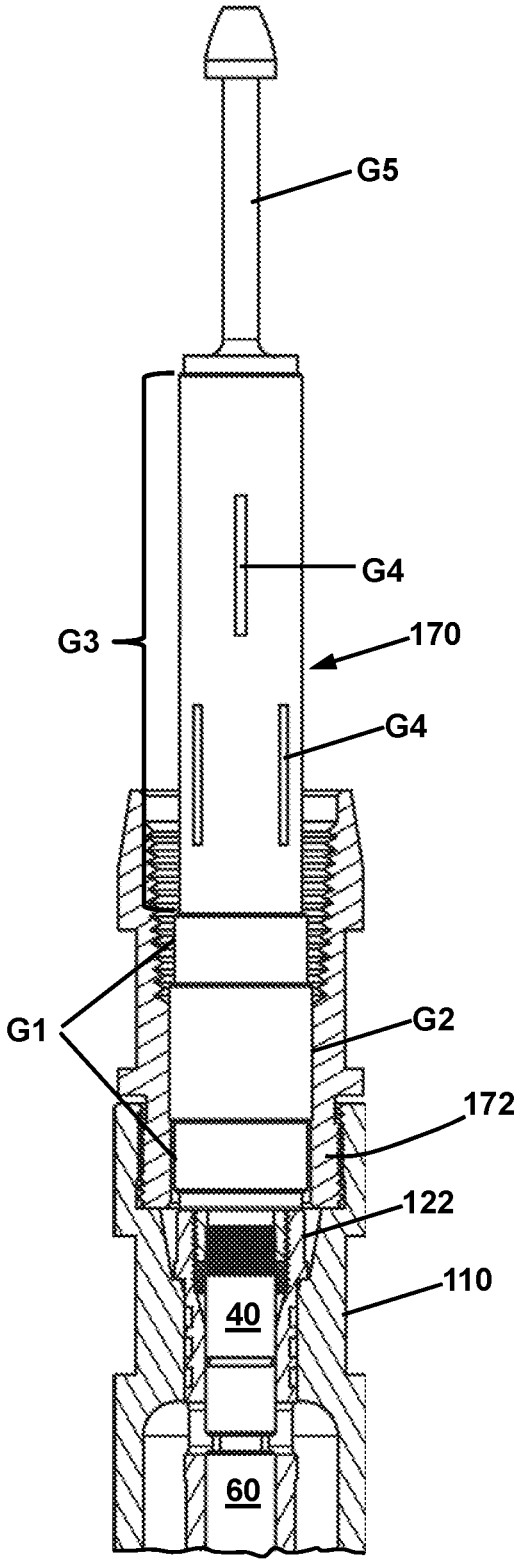
FIG. 7 is a side-cross-sectional view of a filter assembly fitted to the power fluid inlet end of the jet pump.

Referring to FIG. 7, the pump 10 may be provided with a filter/carrier 170, which may be removably joined to the pump cartridge 11 by a threaded fitting 172, or other suitable means. In a preferred embodiment, the filter uses slots rather than holes to improve flow and plugging resistance. The slots G4 in the filter section G3 have slot widths sized to be less that the diameter of jet bore 55 and slot lengths at least 5 times jet bore diameter to preclude debris equal or greater in size than the jet bore diameter from entering the jet nozzle 40 and plugging the jet nozzle 40. The total area of the slotted sections G4 is preferably between about 25 to 100 or more times the area of the jet bore 55 to provide adequate filtration area and flow. The filter housing/carrier 170 includes one or more hard metal rings G1 having a diameter approximately equal to the drift diameter of the tubing 4 and spaced approximately 1 to 3 tubing diameters apart and below the slotted sections G3. The rings G3 serve to keep the carrier 172 and cartridge 11 centered in the tubing 4 when being pumped into or removed from the pump 10. An elastomeric material G2 may be added between the hard metal rings with a diameter approximating drift or the normal diameter of the tubing 4, used to create a seal between the bore of the tubing 4 and the carrier 170 when pumping the carrier 172 and cartridge 11 into or out of well and pump 10. The fishneck G5 is used to retrieve the carrier 170 and cartridge 11 if they become lodged in the tubing 4. When operating in reverse flow, the fishneck G5 and filter section G3 are removed from the carrier 170 and an internal fishing tool component (not shown) replaces the fishneck G3 and a modified filter section G3 with slots G4 is added at fitting 160 of FIG. 4A to provide filtration.

The incorporation of a precision slotted filter 170 into the cartridge 11 or 13 serves to eliminate particulate that might block the jet nozzle bore 52. The precision slots G4 are sized to provide high flow rates, while blocking particulates large enough to plug the jet nozzle bore 52. The slotted filter 170 may be used when the pump in operated in normal or reverse flow. Slot dimensions may be matched to the jet nozzle bore 52, and may be changed if the jet nozzle insert 50 within a cartridge 11 or 13 is exchanged for a jet nozzle insert 50 of a different bore size.

Figure 1B:
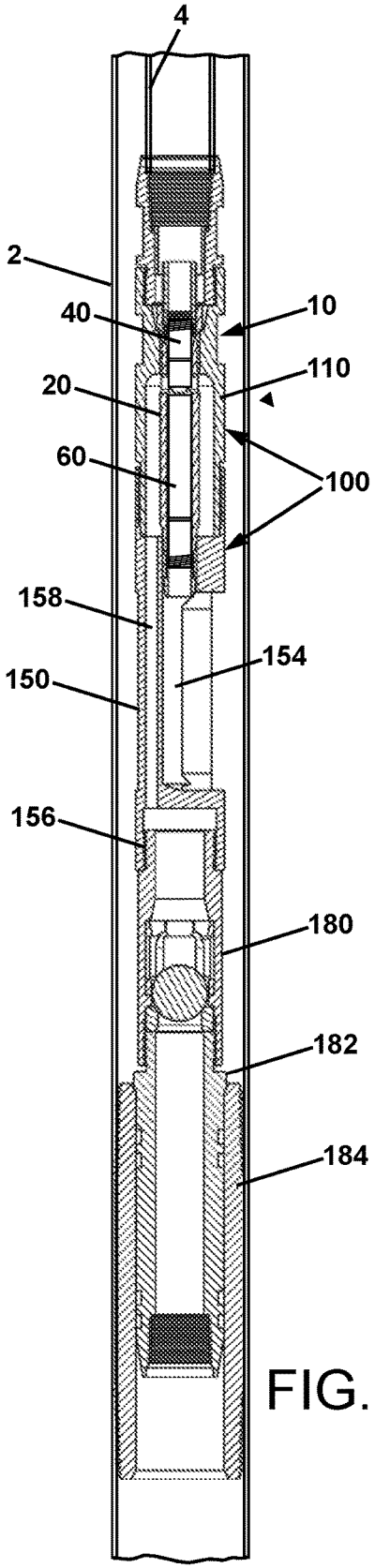
FIG. 1B is a cross-sectional view of the jet pump of FIG. 1A taken along line 1B-1B of FIG. 1A, configured for standard flow.
Figure 1C:
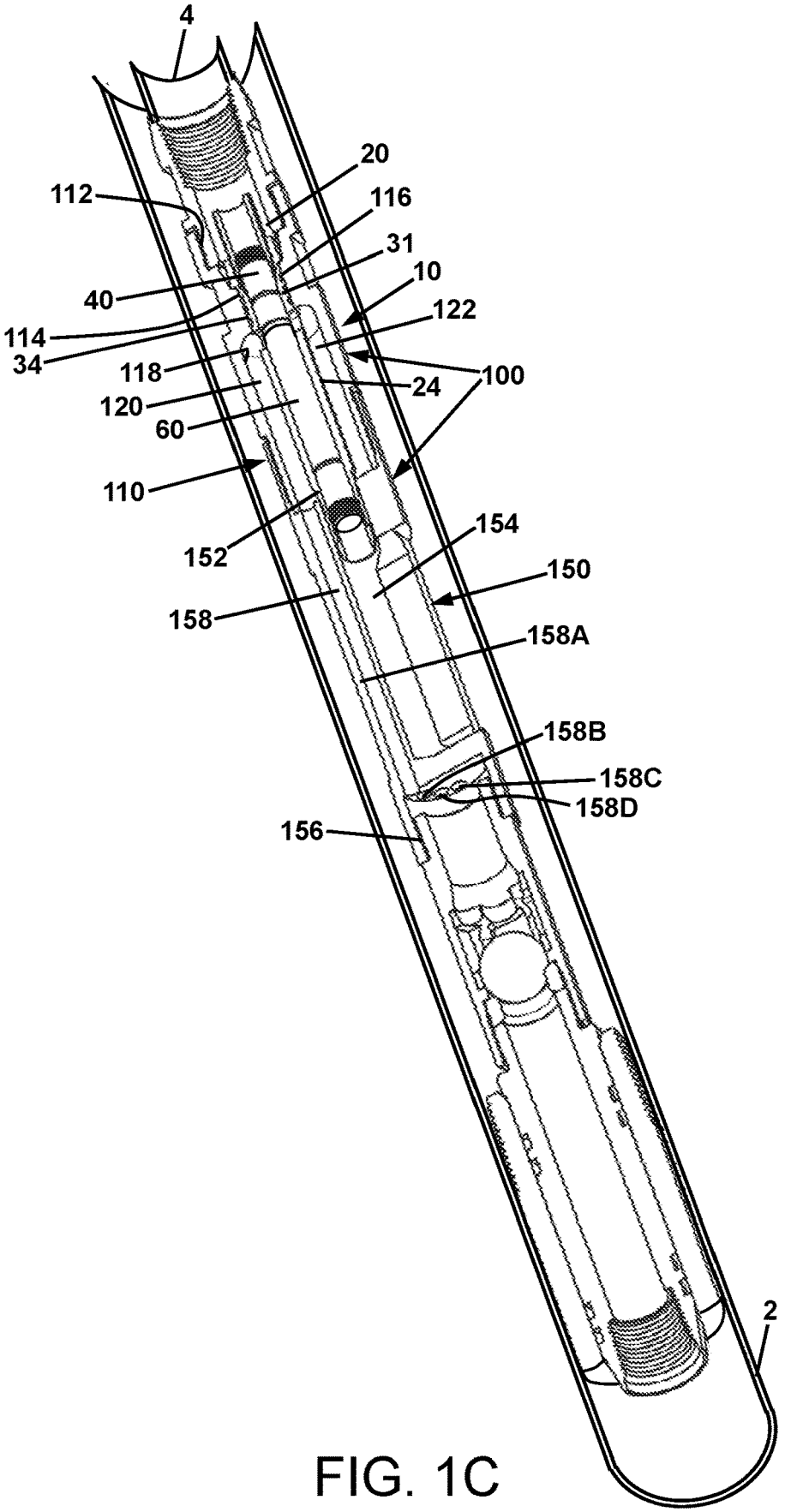
FIG. 1C is a cutaway perspective view of the jet pump of FIG. 1A.
Figure 2A:
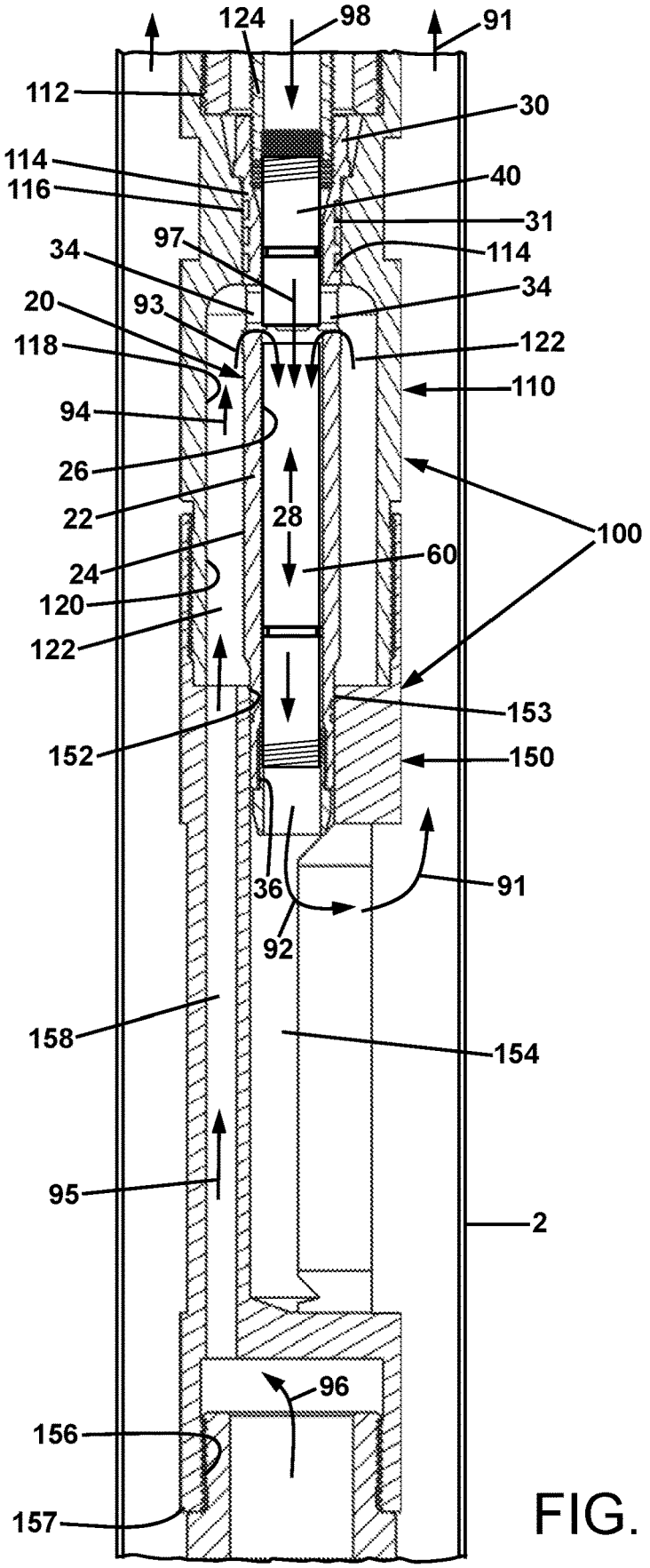
FIG. 2A is a detailed cross-sectional view of a pump cartridge including a jet nozzle and a throat diffuser nozzle, and a pump body of the jet pump configured for standard flow.
Figure 2B:
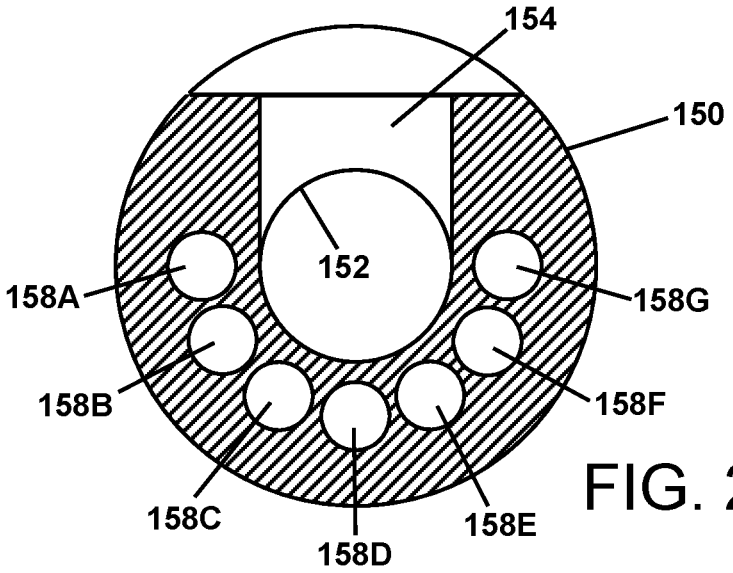
FIGS. 2B-2D are cross-sectional views showing alternative fluid port configurations within the jet pump.
Figure 2C:
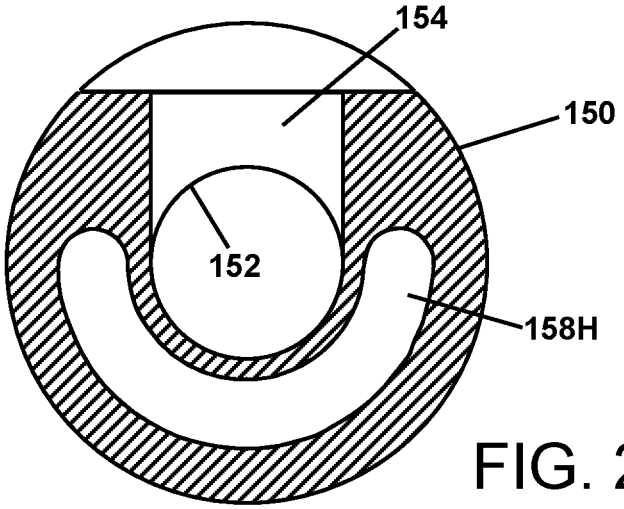
Figure 2D:
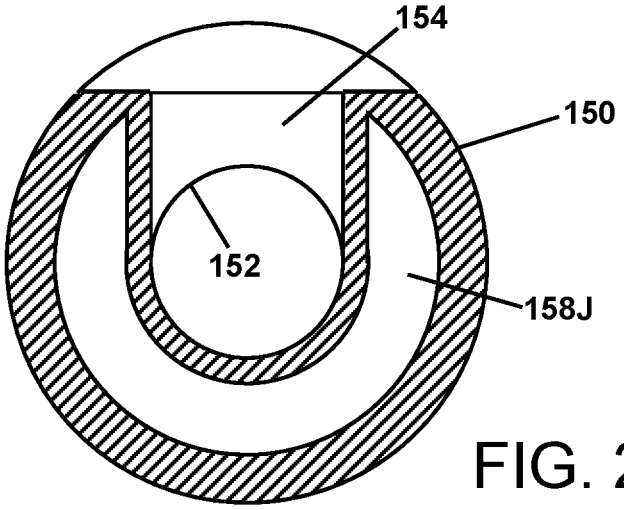

Referring to FIGS. 1A-1C, the pump 10 including housing 100 may be connected to a check valve 180 removably joined to the lower body member 150 of the body 100. The pump 10 and housing 100 are further connect to and/or sealed within the well casing 2 by suitable fittings, e.g., fittings 182 and 184.

The pump 10 may be configured to operate in a "standard" or forward flow mode, or in a reverse flow mode. Operation of the pump in reverse flow mode may be useful in certain circumstances, such as for purging accumulated solid particles (such as sand), avoiding the accumulation of particulate in the annular space between the pump housing 100 and the well casing 2 and maintaining higher mixed fluid return velocities to reduce thermal losses, paraffin caking, gain lift efficiency from gas content, etc.

In the embodiment depicted in FIGS. 1A-1C, FIG. 2, and FIG. 3A, a standard flow configuration is shown. In this configuration, power fluid enters the pump cartridge 11 (arrow 98), and flows through the jet nozzle 40. The fluid passes through the gap 99 (arrow 97) and into the throat diffuser nozzle 60. At this point, the power fluid has been accelerated to a high velocity and low pressure in the gap 99. This low pressure induces flow of the production fluid from the second fluid inlet port 156 (arrow 96) through the longitudinal port 158 (arrow 95), through the annular cavity 122 (arrow 94), and through the through port 34 (arrow 93) into the throat diffuser nozzle 60. The power fluid and production fluid mix, and are expelled from the pump (arrow 92) as a combined fluid. The combined fluid, which in the case of an oil well, includes the desired oil to be extracted, flows upwardly (arrows 91) through the annular space between the pump housing 100 and the well casing 2, and then between the well tubing 4 and the well casing 2 to ground level where it is stored and/or processed further.

Figure 4B:
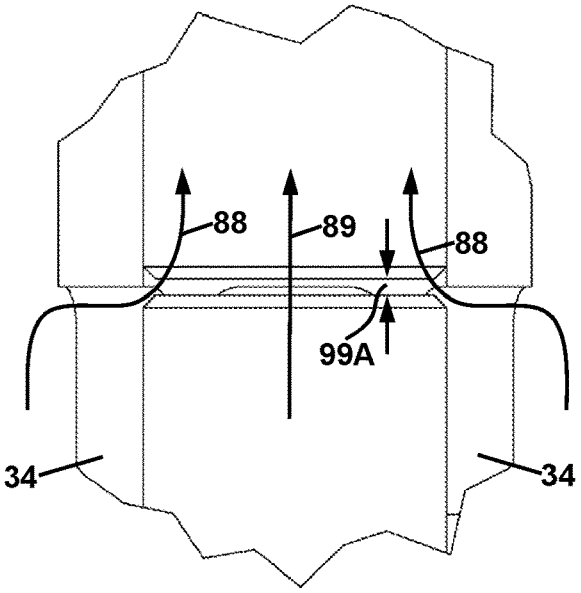
FIG. 4B is a detailed cross-sectional view of the gap region between a jet nozzle and a throat diffuser nozzle of the cartridge of FIG. 4A.

To operate in reverse flow mode, the pump cartridge is configured as cartridge 13 shown in FIGS. 4A and 4B. It can be seen that the positions of the jet nozzle 40 and the throat diffuser nozzle 60 have been inverted within the pump housing 20. (For jet pumps not including a cartridge assembly, the relative positions of the jet nozzle 40 and the throat diffuser nozzle 60 are the same.) Additionally, the through ports 34 in the tubular wall 22 have been relocated to correspond to the lower location of the gap 99A between the jet nozzle 40 and the throat diffuser nozzle 60. In operation of the pump 10 having pump cartridge 13, the power fluid is delivered down through the annular space between the well tubing 4 and the well casing 2, and then between the pump housing 100 and the well casing 2, opposite arrow 91, and then into the fluid inlet 36 (arrow 90). The power fluid flows upwardly through the jet nozzle 40, through the gap 99A, and into the throat diffuser nozzle 60 (arrow 89). In certain embodiments, a filter including filter section G3 with slots G4 may be provided at the fluid inlet 36, with the fluid passing therethrough.

This high velocity/low pressure flow induces flow of the production fluid through gap 99A and into the throat diffuser nozzle 60 (arrows 88). The flow path of the production fluid to the gap 99A is as described previously (arrows 96, 95, 94). The combined fluid flows upwardly (arrows 91) through the throat diffuser nozzle 60 (arrow 87), and upwardly through the well tubing 4 (arrow 86) to ground level.

As noted previously, the pump 10 can be configured as a standard flow cartridge 11 or a reverse flow cartridge 13. The desired pump cartridge can be delivered into the pump housing 100 and withdrawn from the pump housing to change from standard to reverse flow mode. Additionally, in another aspect of the present disclosure, the jet nozzle 40 and throat diffuser nozzle 60 are installed in the cartridges 11 and 13 in a manner such that their axial locations in the tubular housing 22 are adjustable. This feature provides the ability to adjust the gap 99 between the jet nozzle 40 and throat diffuser nozzle 60, without losing concentricity between nozzle bores. Such ability to adjust gap 99 allows the pump 10 to be tuned for optimum performance for the rheology and chemical composition of a particular oil and the level of oil in the well. In operation of the pump 10, data can be obtained which can be used to predict a better pump configuration for that well. A new pump cartridge 11 can be configured with the optimal gap and jet, throat and diffuser configurations for the well conditions, and then the current cartridge withdrawn from the housing 100, and the new pump cartridge delivered into the housing 100. Details on this aspect are as follows.

Referring to FIGS. 3A, 5A, and 5B, the jet nozzle 40 is disposed in the jet nozzle region 33 of the elongated cylindrical central bore portion 32 of the tubular side wall 22 of the pump housing 20 as described previously. Additionally, the jet nozzle 40 is engaged by threads 46 with corresponding threads of a fitting 124 and fixed, the position of which in pump housing 20 is also fixed by engagement of threads 126 with pump housing 20. Thus, by rotation of the fitting 124 relative to the pump housing 20, the axial position of the jet nozzle 40 in the central bore portion 32 of the pump housing 20 is made adjustable as indicated by bidirectional arrow 85, while maintaining concentricity.

In like manner, the throat diffuser nozzle 60 is disposed in the throat diffuser nozzle region 35 of the elongated cylindrical central bore portion 32 of the tubular side wall 22 of the pump housing 20 as described previously. Additionally, the throat diffuser nozzle 60 is engaged by threads 66 with corresponding threads of a fitting 160 and fixed, the position of which in pump housing 20 is also fixed by engagement of threads 162 with pump housing 20. Thus, by rotation of the fitting 160 relative to the pump housing 20, the axial position of the throat diffuser nozzle 60 in the central bore portion 32 of the pump housing 20 is made adjustable as indicated by bidirectional arrow 84, while maintaining concentricity.

By making the axial positions of the jet nozzle 40 and throat diffuser nozzle 60 adjustable within the pump housing 20, the gap 99 between them is rendered adjustable. This adjustability of the width of the gap 99, while maintaining concentricity, makes the pump tunable to particular well conditions as described above.

It is further noted that for the sake of illustration of the adjustment principle, the gap 99A in FIG. 4B is shown in a nearly closed position. Such a gap 99A is not necessarily a suitable operating position, but illustrates adjustability to a minimum gap.

In considering conventional jet pumps, the Applicant observed that many such pumps are made with multiple parts, such that part tolerances "stack up," thereby making it difficult to achieve precise coaxial alignment of the jet nozzle and throat diffuser nozzle within the pump.

A typical design for producing pump housing 20 would require drilling or boring the central passage from each end, requiring the pump housing 20 to be removed and reinserted into a fixturing device, such as a chuck or collet in the machine performing the drilling or boring operation, for drilling or boring the second portion of the central passage. This removal and reinsertion of the pump housing 20 is certain to reduce the concentricity of the non-continuous central bore. A second method often employed is to fixture the jet nozzle in a separate section outside of the bore of the central passage way of pump housing 20, through various coupling methods introducing additive loss of concentricity. This is likely done to provide for the capacity to adjust the gap 99 between jet nozzle 40 and throat diffuser nozzle 60 and simplify nozzle fixturing given the extremely small space available for all the components.

The Applicant hypothesized that there was an opportunity to improve jet pump performance by achieving greater coaxial alignment of the jet nozzle and throat diffuser nozzle, in combination with an ultra-hard material as the internal material that is exposed to the flowing fluids, theorizing that cavitation damage to the throat diffuser wall in the throat diffuser nozzle 60 occurs with the rapid collapse of vapor bubbles against the inner walls 75 and 73 of the throat diffuser nozzle 60, and such damage would be reduced or eliminated if the high velocity jet stream produced through the bore 55 of jet nozzle 40 was perfectly centered on the bore 75 and frustoconical section 73 of throat diffuser nozzle 60 and also in direct alignment, thus not directing the vapor bubbles toward the wall of the wall of bore 75 and frustoconical section 73 of throat diffuser nozzle 60 where they collapse, causing potential erosion. In addition, without wishing to be bound to any particular theory, the Applicant believes that the near perfect concentricity reduces turbulence within the bore 75 and frustoconical section 73 of the throat diffuser nozzle 60, further reducing erosive forces and loss of fluid energy. Finally, the use of ultra-hard material such as polycrystalline diamond (PCD), machined directly from solid PCD pieces into nozzles 40 and 60, or after placement as inserts in the nozzle sections 41 and 61, enhances concentricity and further reduces potential erosion due to cavitation, abrasion from particulate such as sand and corrosive loss from acids and bases contained in the produced fluids.

The design of the pump cartridge 11 and 13 required the production of many prototypes and revisions. The ultimate design objective to develop a hydraulically and/or wireline retrievable cartridge, which was interchangeable with other pump cartridges 11 or 13, which provided for interchange of the jet nozzle 40 and throat diffuser nozzle 60 containing different bore diameters (55 or 75), bore lengths or diffuser lengths/angles, which maximized concentricity of the bore 55 of the jet nozzle 40 and bore 75 of the throat diffuser nozzle 60, with the outside diameter of jet nozzle 40 and throat diffuser nozzle 60 having the same outside diameter, and which used ultrahard materials that would enable the jet pump 10 to operate both in and out of the cavitation zone, was attained with this invention.

The first element required to meet the concentricity requirement is to have the jet nozzle 40 and throat diffuser nozzle 60 contained and aligned in a single continuous bore that is strong and concentric from end to end as seen in the central bore portion 32 of the pump housing 20. This bore can be machined in several ways. One preferred method is to drill and ream the central bore portion 32 of the pump housing 20 in single full length operations, providing a precise diameter and very straight bore to align the jet nozzle 40 and throat diffuser nozzle 60 within. It should be noted that the alignment of the inner bore wall 26 and the outer wall 24 of pump housing 20 is non-critical and does not enter into the design effectiveness. It is noted that in one embodiment, not shown, of making the jet nozzle 40 and throat diffuser nozzle 60, the entire respective pieces 40 and 60 may be made as described herein from pieces of polycrystalline diamond as the desired ultrahard material. The respective constant diameter bores 55 and 75, and the frustoconical regions 43, 53, 63, and 73 may be formed by laser cutting or EDM. Additionally, the threads 46 and 56 and notches 49 and 69 may be formed by laser cutting or EDM. However, the sourcing of such large monolithic pieces of PCD, and the associated machining of them may add to the expense of making the pump 10. Thus at the present time, the fabrication of PCD inserts as described herein is preferred way to reduce pump manufacturing costs.

A large contact surface area between the bore wall 26 of bore 32 of pump housing 20 and the outer walls of jet nozzle 40 and throat diffuser nozzle 60 is preferred. The combination of a tight slip fit between the OD of the jet nozzle 40 and throat diffuser nozzle 60 and the bore wall 26 of bore 32 of pump housing 20 and the large contact area of the various surfaces assures sufficiently precise alignment to yield very high concentricity.

Additionally, there is a need to be able to position and hold the jet nozzle 40 and throat diffuser nozzle 60 at the appropriate location within the bore 32 of pump housing 20 while maintaining concentricity. This is accomplished by first adding threaded connectors 124 and 160, using their inner threads, to connect to the threaded areas 30 and 66 at the ends of the jet nozzle 40 and throat diffuser nozzle 60. Then, the threads 126 and 162 of threaded connectors 124 and 160 are entered into the threaded sections 112 and 156 of the pump housing 20. This yields cartridges 11 and 13 that are fully integrated and highly concentric, while making it easy to swap out the jet nozzle 40 and throat diffuser nozzle 60 inserts without loss of concentricity. The threaded fittings 124 and 160, respectively, may be included in a single piece jet nozzle 40 or throat diffuser nozzle 60. Although fabrication of such nozzle structures is more difficult, such a design may be useful in certain applications.

A common problem with ultra-hard materials is that they are very difficult to machine, since there are few tools that can cut or abrade them. Through experimentation, the Applicant selected polycrystalline diamond as a material for the jet nozzle 40 and throat diffuser nozzle 60. Because polycrystalline diamond can be designed to be electrically conductive, it can be machined to precise dimensions by electro discharge machining (EDM). Thus, a process for fabrication of a jet nozzle 40 was developed, in which the jet cylindrical body 41 was machined to have an axial bore 42 that was coaxial with the outer cylindrical wall of the body 41 and dimensioned to receive the jet nozzle insert 50 with a mild interference fit. In certain embodiments (not shown), the axial bore 42 of the jet cylindrical body 41 may be provided with a small taper or ridge at the distal end 48 thereof. The jet nozzle insert 50 may be made with a matching taper or ridge, such that when the insert 50 is fitted into the body 41, the tapers or ridges are contiguous, thereby retaining the insert 50 within the body 41 during use of the pump 10.

The starting piece for making the jet nozzle insert 50 of polycrystalline diamond is provided in cylindrical form with or without a central through hole, and pressed, bonded, braised or otherwise fixed into the axial bore 42 of the jet nozzle body 41. In certain embodiments, a suitable adhesive, such as Loctite® thread adhesive may be used in fitting the unfinished jet nozzle insert piece into the jet nozzle body 41. In certain embodiments (not shown), the jet nozzle insert 50, may incorporate a tapered section of minus 150 to plus 150 degrees or ridge at the distal end 48 of the throat diffuser nozzle insert 40. In such a case, the polycrystalline diamond bore exit may extend beyond or be recessed within the jet nozzle body 41. At this point, EDM cutting may be used to form the final constant diameter portion 55 and the frustoconical region 53 contiguous with a frustoconical region 43 of the axial inner bore 42 of the jet cylindrical body 41. The jet nozzle body 41 outside diameter to bore 55/taper 53 center line is machined to a minimum +0/−0.001 inch concentricity tolerance. It is also possible to first machine the jet nozzle body 41 to finish tolerance and then EDM machine the bore 55 and taper 43 to finish tolerance. This process limits the stack up error from the OD of the jet nozzle body 41 outside diameter to the bore 55 and the frustoconical region 53 contiguous with a frustoconical region 43, as any errors in the fit or alignment of the axial bore 42 and the jet nozzle insert 50 are eliminated, thereby yielding a highly concentric jet nozzle 40. Polishing of the bore 55 and/or taper 53 may occur after bore and taper formation.

In like manner, a similar process is used to fabricate a throat diffuser nozzle 60. The starting piece for making the throat diffuser cylindrical body 61 is machined to have an axial bore 62 that is coaxial with the outer cylindrical wall of the body 61 and dimensioned to receive the throat diffuser nozzle insert 70 with a mild interference fit. The throat diffuser nozzle insert 70 of polycrystalline diamond is provided in cylindrical form with or without a central through hole, and pressed, bonded, braised or otherwise fixed into the axial bore 62 of the throat diffuser nozzle body 61. In certain embodiments (not shown), the axial bore 72 of the throat diffuser cylindrical body 61 may be provided with a small taper or ridge at the distal end 78 of the throat diffuser nozzle insert 70. The throat diffuser nozzle insert 70 may be made with a matching taper or ridge, such that when the insert 70 is fitted into the body 61, the tapers or ridges are contiguous, thereby retaining the insert 70 within the body 61 during use of the pump 10. Suitable adhesive may be used as described above. At this point, EDM, laser machining, or an alternatively suitable subtractive machining process, may then be used to form the final constant diameter portion 75 and the frustoconical region 73 contiguous with a frustoconical region 63 of the axial inner bore 62 of the throat diffuser cylindrical body 61. The throat diffuser nozzle body 61 outside diameter to bore 75/taper 73 center line is machined to a minimum +0/−0.001 inch diameter and concentricity tolerance. It is also possible to first machine the throat diffuser nozzle body 61 to finish tolerance and then machine the bore 75 and taper 73 to finish tolerance. The throat diffuser nozzle body 61 outside diameter to bore diameter is machined to a minimum +0/−0.001 inch concentricity tolerance. This process limits the stack up error from the OD of the throat diffuser nozzle body 61 outside diameter to the bore 75 and the frustoconical region 73 contiguous with a frustoconical region 63, as any error in the fit or alignment of the axial bore 62 and the throat diffuser nozzle insert 70 are eliminated when the final constant diameter bore portion 75 and the frustoconical region 73 contiguous with a frustoconical region 63 are EDM machined, thereby yielding a highly concentric throat diffuser nozzle 60. Polishing of the bore 75 and/or taper 63/73 may occur after bore and taper formation.

In some cases, the length of the throat diffuser nozzle 60 may exceed the length (currently about 3.5 inches) that can be economically machined by available suitable subtractive material machining processes. In this case, the throat diffuser nozzle 60 may be fabricated in two or more sections comprised of throat diffuser cylindrical bodies 61 containing throat diffuser nozzle inserts 70, or sections of throat diffuser nozzle 60 made of extremely hard material, to allow for fabrication of the constant diameter portion 75 and diffuser frustoconical region 73, using the same processes as described previously for the combined throat diffuser 60. After completion of these sections, they may be joined using threads, interference fit, brazed together to form a single piece throat diffuser nozzle 60, or simply stacked and fixed with an adhesive inside the elongated cylindrical central bore portion 32 of the tubular side wall 22 of the pump housing 20. In these embodiments, given that the presence of interfacial material such as adhesive or brazing compound is minimal and has no effect on the function of the throat diffuser nozzle, the throat diffuser nozzle utilizing multiple segments 61 is equivalent to the single section nozzle 60, whether utilizing throat diffuser cylindrical body 61 or being made entirely of the extremely hard material. A throat diffuser nozzle 60 comprised of sections of only extremely hard material joined together by brazing or another suitable method consists essentially of the extremely hard material. Additionally, a jet nozzle 40 may be fabricated in two or more sections 41 containing insert 42 with axial bore 55 and a frustoconical region 43. Alternatively, the sections 41 may be made entirely of the extremely hard material containing axial bore 55 and a frustoconical region 43. The sections 41 may then be mounted and/or joined as described above for the throat diffuser cylindrical body 61. A jet nozzle 40 comprised of sections of only extremely hard material joined together by brazing or another suitable method consists essentially of the extremely hard material.

Next, when the jet nozzle 40 and throat diffuser nozzle insert 60, having the same body outside diameters, are placed into the straight through precision finished pump housing elongated cylindrical central bore portion 32 along wall 26 of the tubular side wall 22 of the pump housing 20 with a light contact fit, the large contact surface areas between the nozzle outer bodies and the pump housing bore yield sufficiently precise concentricity to render the pump operable with the unique capabilities described herein. This high degree of concentricity resulting from the large surface contact areas between the jet nozzle 40 and throat diffuser nozzle insert 60 outer bodies and the elongated cylindrical central bore portion 32 of the tubular side wall 22 of the pump housing 20 is maintained, even as the fitting 124 or fitting 160 are rotated to establish the desired 99 or 99A gap.

As a result of this choice of materials and fabrication techniques, the Applicant's pump 10 has been found to be capable of operating for prolonged periods under cavitation, while creating significant negative suction head on the production fluid, and not undergoing significant erosion of the jet nozzle 40 and throat diffuser nozzle 60. The ability to operate a jet pump in cavitation runs counter to standard practice with conventional jet pumps.

Figure 8:
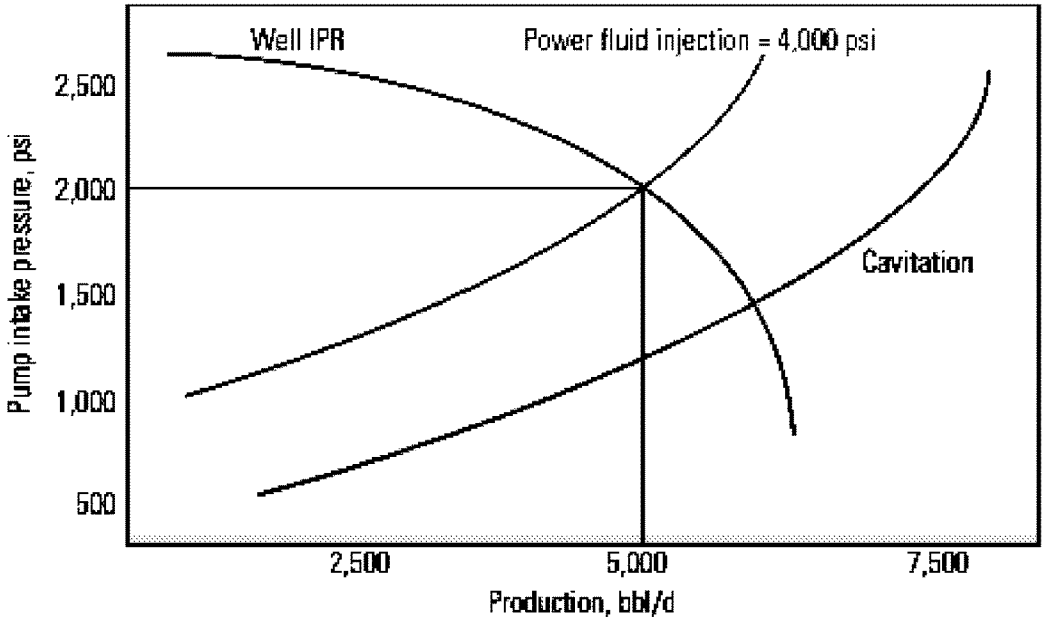
FIG. 8 is a performance plot for a conventional jet pump system.

By way of illustration, FIG. 8 is a performance plot for a conventional jet pump system. This plot is sourced from Oilfield Review 2016, "The Defining Series, Jet Pumps," Moon, T, available at https://www.slb.com/-/media/Files/resources/oilfield_review/defining_series/Defining-Jet-Pumps.pdf?la=en&hash=196786A4CBF0CF59AB9954050E09B3BB65D8D641.

Figure 9:
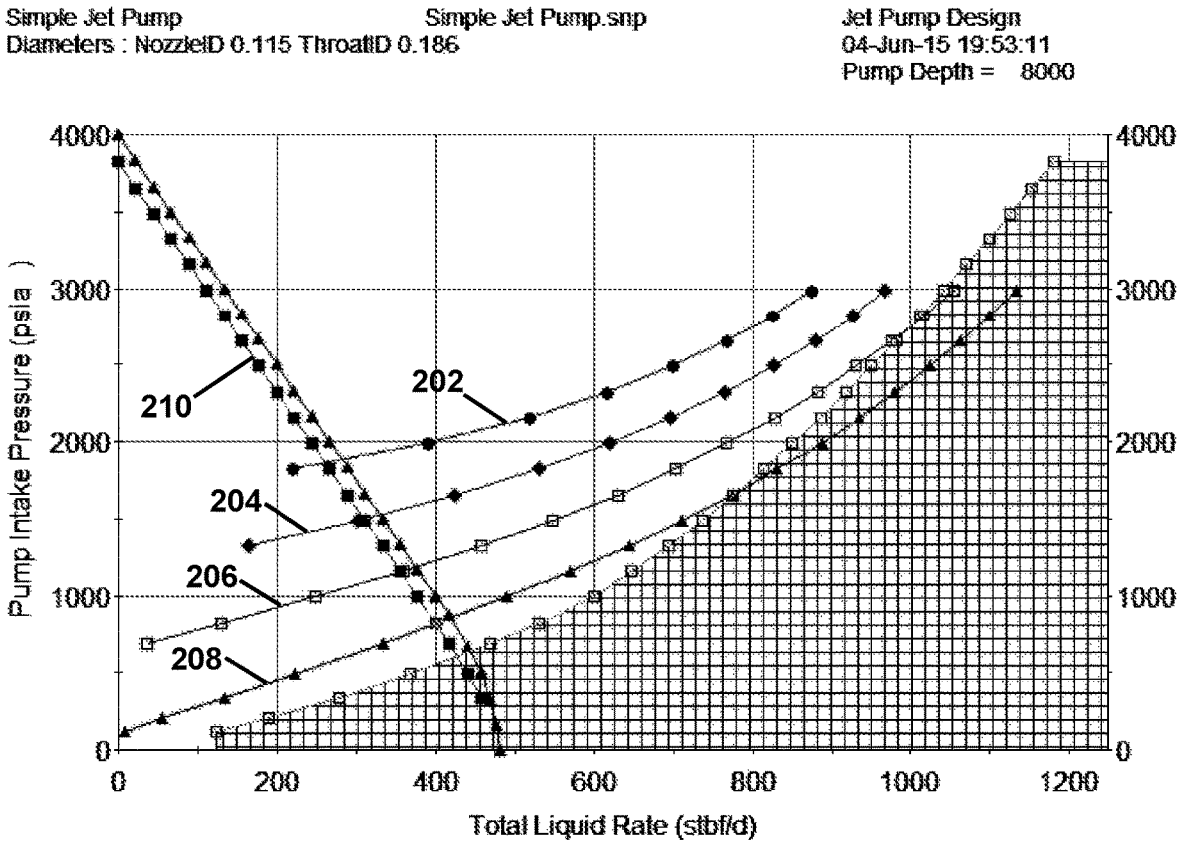
FIG. 9 is a set of performance plots for a conventional jet pump system.

FIG. 9 presents a graphical representation of key relationships according to conventional practice with known jet pumps regarding the production of fluids from wells. Salient parameters are Pump Intake Pressure (psi), Power Fluid Injection Pressure (at surface) and the well's Inflow Performance Relationship (IPR) in barrels per day. It can be seen that as the pump inlet pressure decreases as a result of the draw down (extraction) of the production fluid, the production fluid produced increases, since there is less back pressure on the producing formation. Conventional wisdom with known jet pumps, as explicitly stated by Moon in this reference, is that jet pump operation should be maintained such that the IPR curve stays to the left and above the cavitation line. This means that maximum potential daily production of 6,000+ bpd cannot be reached, as attempting to do so would result in cavitation in the pump.

FIG. 9 is a set of performance plots for a conventional jet pump systems, obtained at http://nationsconsultinginc.com/snap.html, and entitled, "Well Performance (nodal) Software for the Oil & Gas Industry; Gas-Lift Design, Analysis & Troubleshooting; and Jet Pump Design." FIG. 9 presents information similar to that described in FIG. 8, but in greater detail. The graph shows several different increasing surface pump pressures plots 202, 204, 206, and 208, with estimated Pump Intake Pressure vs. Daily Production (Total Liquid Rate). The IPR Curve 210 intersects each of the surface pump pressure plots 202-208. It is important to note that all line intersection points of IPR curve 210 with the plots 202-208 remain out of the cavitation zone, as per the state of the current art for conventional jet pumps.

Figure 10:
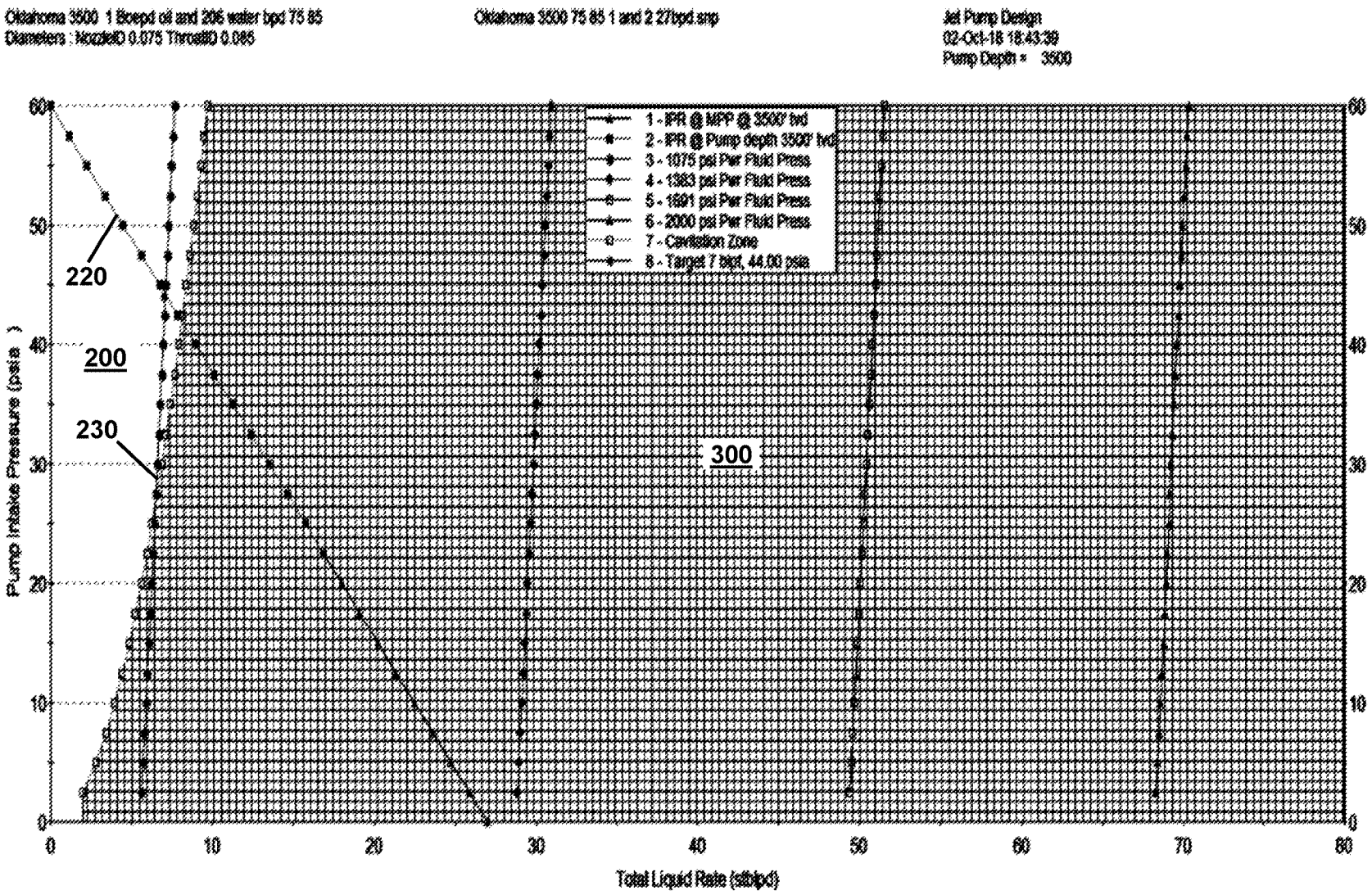
FIG. 10 is a performance plot for a prototype jet pump of the present disclosure.

In contrast, FIG. 10 is a simulated performance plot for a prototype jet pump 10 of the present disclosure. The prototype pump had a jet nozzle and throat diffuser nozzle made of carbide brazed into a single central bore tube. The pump was operated for a total of six days, producing an average of 27.9 barrels per day (bpd). (The rod pump that it replaced had been producing roughly 24 bpd.) The pump was able to extract all liquids in the well down to the level of the pump. The pump produced a flow rate of about 5 to 10 percent more fluid than the rod pump it replaced.

It can be seen that the pump of the present disclosure can operate in both the traditional non-cavitation zone 200 as well as operating in the cavitation zone 300. According to current art, the pump 10 should be able to produce between 7 and 8 barrels of fluid per day, while running in the non-cavitation zone 200. This is represented by the intersection of the IPR curve 220 and the cavitation curve 230. It can be seen that the pump 10 of the present disclosure is able to pump production fluid in the cavitation zone 300, in fact drawing fluid levels down to a level yielding a pump intake pressure of zero (in some cases negative pressure, not shown) while producing 27 barrels of fluid per day. The capacity to operate at higher surface pump pressures and lower pump intake pressures also can enable the use of smaller surface pumps requiring less horse power, thereby reducing capital outlays and reduced energy consumption.

In summary, the jet pump as set forth in the present disclosure is advantageous over conventional jet pumps because it can operate effectively as a conventional jet pump out of cavitation as well as operating in cavitation while not undergoing excessive erosion of the key components therein. The capacity to pump in cavitation also provides for the use of smaller tubular strings, operation at higher pressures and lower power fluid flow rates and pump at lower pump inlet pressures, thereby consuming less energy and potentially increasing production by lowering pump inlet net positive suction head and thereby reducing formation back pressure and increasing formation fluid flow. Additionally, the jet pump is advantageous because of the incorporated high capacity slot filtration of incoming power fluid that precludes inadvertent plugging of the jet nozzle by particulate introduced into the power fluid stream from the surface fluids, contaminates introduced during tubing insertion or from materials shedding from tubular bores.

It is therefore apparent that there has been provided, in accordance with the present disclosure, a jet pump. The foregoing description of technology and the invention is merely exemplary in nature of the subject matter, manufacture, and use of the invention and is not intended to limit the scope, application, or uses of any specific invention claimed in this application or in such other applications as may be filed claiming priority to this application, or patents issuing therefrom. The following definitions and non-limiting guidelines must be considered in reviewing the description.

The headings in this disclosure (such as "Background" and "Summary") and sub-headings used herein are intended only for general organization of topics within the present technology, and are not intended to limit the disclosure of the present technology or any aspect thereof. In particular, subject matter disclosed in the "Background" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

To the extent that other references may contain similar information in the Background herein, said statements do not constitute an admission that those references are prior art or have any relevance to the patentability of the technology disclosed herein. Any discussion in the Background is intended merely to provide a general summary of assertions.

The description and specific examples, while indicating embodiments of the technology disclosed herein, are intended for purposes of illustration only and are not intended to limit the scope of the technology. Moreover, recitation of multiple embodiments having stated features is not intended to exclude other embodiments having additional features, or other embodiments incorporating different combinations of the stated features. Specific examples are provided for illustrative purposes of how to make and use the compositions and methods of this technology and, unless explicitly stated otherwise, are not intended to be a representation that given embodiments of this technology have, or have not, been made or tested.

To the extent employed herein, the words "preferred" and "preferably" refer to embodiments of the technology that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the technology.

Unless otherwise specified, relational terms used in the present disclosure should be construed to include certain tolerances that those skilled in the art would recognize as providing equivalent functionality. By way of example, the term perpendicular is not necessarily limited to 90.00°, but also to any variation thereof that those skilled in the art would recognize as providing equivalent functionality for the purposes described for the relevant member or element. Terms such as "about" and "substantially" in the context of configuration relate generally to disposition, location, and/or configuration that is either exact or sufficiently close to the location, disposition, or configuration of the relevant element to preserve operability of the element within the invention while not materially modifying the invention. Similarly, unless specifically specified or clear from its context, numerical values should be construed to include certain tolerances that those skilled in the art would recognize as having negligible importance, as such do not materially change the operability of the invention.

As used herein, the words "comprise," "include," contain," and variants thereof are intended to be non-limiting, such that recitation of items in a list is not to the exclusion of other like items that may also be useful in the materials, compositions, devices, and methods of this technology. Similarly, the terms "can" and "may" and their variants are intended to be non-limiting, such that recitation that an embodiment can or may comprise certain elements or features does not exclude other embodiments of the present technology that do not contain those elements or features.

All numbers disclosed herein are approximate values, regardless whether the word "about" or "approximate" is used in connection therewith. They may vary by 1%, 2%, 5%, and sometimes, 10 to 20%. Disclosure of values and ranges of values for specific parameters are not exclusive of other values and ranges of values useful herein.

Having thus described the basic concept of the invention, it will be apparent to those skilled in the art that the foregoing detailed disclosure is intended to be presented by way of example only, and is not limiting. Various alterations, improvements, and modifications will occur to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be expressly stated in the claims.

I claim:

1. A jet pump comprising:

a) a pump housing comprised of a tubular side wall including an outer central side wall region, and an inner side wall defining a central passageway including a first fluid inlet portion, an elongated cylindrical bore portion in fluid communication with the first fluid inlet portion and having at least one through port extending through the outer central side wall region, and a combined fluid outlet portion in fluid communication with the elongated cylindrical bore portion;

b) a jet nozzle disposed in a jet nozzle region of the elongated cylindrical bore portion of the tubular side wall of the pump housing, and comprising:

a jet cylindrical body formed of a jet nozzle outer material, disposed in the jet nozzle region of the elongated cylindrical bore portion of the pump housing, and including an axial inner bore therethrough;

a jet nozzle insert formed of a jet nozzle inner material, disposed in the axial inner bore of the jet cylindrical body, and including an axial inner bore therethrough coaxial with the axial inner bore of the jet cylindrical body and comprised of a frustoconical region contiguous with a frustoconical region of the axial inner bore of the jet cylindrical body; and c) a throat diffuser nozzle disposed in a throat diffuser nozzle region of the elongated cylindrical bore portion of the tubular side wall of the pump housing, and comprising:

a throat diffuser cylindrical body formed of a throat diffuser nozzle outer material, disposed in the throat diffuser nozzle region of the elongated cylindrical bore portion of the pump housing, and including an axial inner bore therethrough; and a throat diffuser nozzle insert formed of a throat diffuser nozzle inner material, disposed in the axial inner bore of the throat diffuser cylindrical body, separated from the jet nozzle insert by a gap located at the through port of the elongated cylindrical central bore portion of the tubular side wall, and including an axial inner bore therethrough coaxial with the axial inner bore of the throat diffuser cylindrical body and comprised of a frustoconical region contiguous with a frustoconical region of the axial inner bore of the throat diffuser cylindrical body.

2. The jet pump of claim 1, further comprising a pump body comprised of:

a) a first fluid inlet port in communication with an upper central passageway including an inner side wall contiguous with an outer upper side portion of the tubular side wall of the pump housing;

b) a middle central passageway in communication with the upper central passageway and including an inner side wall surrounding the outer central side wall region of the tubular side wall of the pump housing and defining an annular cavity therebetween in fluid communication with the at least one through port extending through the outer central side wall region;

c) a lower central passageway in communication with the middle central passageway, and in communication with an outlet port in the pump body, and including an inner side wall contiguous with an outer lower side portion of the tubular side wall of the pump housing; and d) a second fluid inlet port at a distal end of the pump body in fluid communication with the annular cavity.

3. The jet pump of claim 2, wherein the pump body is comprised of an upper body member including the first fluid inlet port and the middle central passageway joined to a lower body member including the lower central passageway and the second fluid inlet port.

4. The jet pump of claim 2, further comprising a plurality of longitudinal fluid ports extending axially through the pump body from the second fluid inlet port to the annular cavity.

5. The jet pump of claim 2, further comprising an elongated partial annular passageway extending axially through the pump body from the second fluid inlet port to the annular cavity.

6. The jet pump of claim 5, wherein the elongated partial annular passageway extends around the pump body perpendicular to a longitudinal axis of the elongated partial annular passageway through an angle of at least 120 degrees.

7. The jet pump of claim 2, wherein the pump housing is radially offset from a central axis of the pump housing.

8. The jet pump of claim 1, wherein the jet nozzle inner material and the throat diffuser nozzle inner material have a hardness value of 8 on the Mohs scale of hardness.

9. The jet pump of claim 1, wherein the jet nozzle inner material and the throat diffuser nozzle inner material are selected from the group consisting of polycrystalline diamond, titanium carbide, silicon carbide, boron carbide, polycrystalline cubic boron nitride, hardened steel, and monocrystalline diamond.

10. The jet pump of claim 1, wherein the jet nozzle inner material and the throat diffuser nozzle inner material are polycrystalline diamond.

11. The jet pump of claim 1, wherein the axial inner bore of the jet nozzle insert is formed relative to the outside surface area of the jet nozzle body, and the axial inner bore of the throat diffuser nozzle insert is formed relative to the outside surface area of the throat diffuser nozzle body and both are placed into a common elongated continuous diameter cylindrical bore portion of the tubular side wall of the pump housing, where both jet nozzle and the throat diffuser nozzle are adjustable linearly within the common elongated continuous diameter cylindrical bore portion of the tubular side wall of the pump housing.

12. The jet pump of claim 1, wherein a jet nozzle insert piece is fitted into the jet cylindrical body, and the frustoconical region of the jet nozzle insert contiguous with the frustoconical region of the axial inner bore of the jet cylindrical body are then formed by a machining tool, and wherein a throat diffuser nozzle insert piece is fitted into the throat diffuser cylindrical body, and the frustoconical region of the throat diffuser nozzle insert contiguous with the frustoconical region of the axial inner bore of the throat diffuser cylindrical body are then formed by the machining tool.

13. The jet pump of claim 1, wherein the axial inner bore of the jet nozzle insert is further comprised of a region of constant diameter in fluid communication with the frustoconical region of the axial inner bore of the jet nozzle insert.

14. The jet pump of claim 1, further comprising a slotted filter joined to and in fluid communication with the first fluid inlet portion of the pump housing.

15. A jet pump comprising:

a) a pump housing comprised of a tubular side wall including an outer central side wall region, and an inner side wall defining a central passageway including a first fluid inlet portion, an elongated cylindrical bore portion in fluid communication with the first fluid inlet portion and having at least one through port extending through the outer central side wall region, and a combined fluid outlet portion in fluid communication with the elongated cylindrical bore portion;

b) a jet nozzle disposed in a jet nozzle region of the elongated cylindrical bore portion of the tubular side wall of the pump housing, the jet nozzle consisting essentially of a material having at least a hardness value of 8 on the Mohs scale of hardness; and c) a throat diffuser nozzle disposed in a throat diffuser nozzle region of the elongated cylindrical bore portion of the tubular side wall of the pump housing, the throat diffuser nozzle consisting essentially of a material having at least a hardness value of 8 on the Mohs scale of hardness;

wherein an axial inner bore of the jet nozzle is formed relative to an outside surface area of the jet nozzle, and an axial inner bore of the throat diffuser nozzle is formed relative to an outside surface area of the throat diffuser nozzle body and wherein the jet nozzle and the throat diffuser nozzle are placed into a common elongated continuous diameter cylindrical bore portion of the tubular side wall of the pump housing, where both the jet nozzle and the throat diffuser nozzle are adjustable linearly within the common elongated continuous diameter cylindrical bore portion of the tubular side wall of the pump housing.

16. The jet pump of claim 15, wherein the jet nozzle inner material and the throat diffuser nozzle inner material are selected from the group consisting of polycrystalline diamond, titanium carbide, silicon carbide, boron carbide, polycrystalline cubic boron nitride, hardened steel, and monocrystalline diamond.

17. The jet pump of claim 15, wherein the jet nozzle inner material and the throat diffuser nozzle inner material are polycrystalline diamond.

18. The jet pump of claim 15, wherein the jet nozzle is made of a first piece of the material having at least a hardness value of 8 on the Mohs scale of hardness, and the throat diffuser nozzle is made of a second piece of the material having at least a hardness value of 8 on the Mohs scale of hardness.

19. The jet pump of claim 15, wherein the jet nozzle is made of a first piece of the material having at least a hardness value of 8 on the Mohs scale of hardness, and the throat diffuser nozzle is made of a second piece of the material having at least a hardness value of 8 on the Mohs scale of hardness joined to at least a third piece of the material having at least a hardness value of 8 on the Mohs scale of hardness.

* * * * *